US009856747B2

(12) United States Patent
Davis et al.

(10) Patent No.: US 9,856,747 B2
(45) Date of Patent: Jan. 2, 2018

(54) NOZZLE GUIDE VANE WITH COOLED PLATFORM FOR A GAS TURBINE

(75) Inventors: Anthony Davis, Bassingham (GB); Paul Mathew Walker, Dunholme (GB)

(73) Assignee: SIEMENS AKTIENGESELLSCHAFT, Münich (DE)

( * ) Notice: Subject to any disclaimer, the term of this patent is extended or adjusted under 35 U.S.C. 154(b) by 1032 days.

(21) Appl. No.: 13/809,963

(22) PCT Filed: Jun. 17, 2011

(86) PCT No.: PCT/EP2011/060144

§ 371 (c)(1),
(2), (4) Date: Mar. 27, 2013

(87) PCT Pub. No.: WO2012/007250

PCT Pub. Date: Jan. 19, 2012

(65) Prior Publication Data

US 2013/0209231 A1 Aug. 15, 2013

(30) Foreign Application Priority Data

Jul. 15, 2010 (EP) ..... 10007335

(51) Int. Cl.
*F01D 25/12* (2006.01)
*F01D 9/04* (2006.01)

(52) U.S. Cl.
CPC ..... *F01D 25/12* (2013.01); *F01D 9/041* (2013.01); *F05D 2240/81* (2013.01); *Y10T 29/49316* (2015.01)

(58) Field of Classification Search
CPC ..... F05D 2240/81; F05B 2240/801; F01D 25/12; F01D 9/04–9/047; F01D 5/087; F01D 5/187
See application file for complete search history.

(56) References Cited

U.S. PATENT DOCUMENTS 4,353,679 A * 10/1982 Hauser ..... F01D 5/189 165/47
5,538,393 A 7/1996 Kane
(Continued)

FOREIGN PATENT DOCUMENTS

CN 1162345 A 10/1997
EP 0680547 B1 5/1997
(Continued)

*Primary Examiner* — Mark Laurenzi
*Assistant Examiner* — Xiaoting Hu

(57) ABSTRACT

A platform for supporting a nozzle guide vane for a gas turbine is provided. The platform has a gas passage surface arranged to be in contact with a streaming operation gas, and a cooling channel for guiding a cooling fluid within the cooling channel formed in an inside of the platform. A cooling portion of an inner surface of the cooling channel is in thermal contact with the gas passage surface. The platform is an integrally formed part representing a segment in a circumferential direction of the gas turbine. The cooling channel has a first cooling channel portion and a second cooling channel portion arranged downstream of the first cooling channel portion with respect to a streaming direction of the operation gas. The first cooling channel portion and the second cooling channel portion are interconnected.

14 Claims, 3 Drawing Sheets

(56) References Cited

U.S. PATENT DOCUMENTS

| | | | | |
|---|---|---|---|---|
| 5,545,002 | A | 8/1996 | Bourguignon | |
| 6,036,436 | A * | 3/2000 | Fukuno | F01D 5/187 415/115 |
| 6,092,983 | A | 7/2000 | Aoki | |
| 6,142,730 | A | 11/2000 | Arase | |
| 6,254,333 | B1 * | 7/2001 | Merry | F01D 5/187 29/889.2 |
| 8,011,881 | B1 * | 9/2011 | Liang | F01D 5/187 415/115 |
| 2002/0098078 | A1 | 7/2002 | Florjancic | |
| 2004/0018082 | A1 * | 1/2004 | Soechting | F01D 5/187 415/115 |
| 2009/0169360 | A1 * | 7/2009 | Broomer | F01D 9/042 415/115 |

FOREIGN PATENT DOCUMENTS

| | | | |
|---|---|---|---|
| EP | 0911489 | A1 | 4/1999 |
| EP | 0955449 | A1 | 11/1999 |
| EP | 1074695 | A2 | 2/2001 |
| EP | 1074696 | A2 | 2/2001 |
| EP | 1219781 | A2 | 7/2002 |
| EP | 1621727 | A1 | 2/2006 |
| RU | 2369747 | C1 | 10/2009 |
| RU | 2382885 | C2 | 2/2010 |
| WO | WO 2006029983 | A1 | 3/2006 |
| WO | WO 2011157549 | A1 | 12/2011 |

* cited by examiner

NOZZLE GUIDE VANE WITH COOLED PLATFORM FOR A GAS TURBINE

CROSS REFERENCE TO RELATED APPLICATIONS

This application is the US National Stage of International Application No. PCT/EP2011/060144 filed Jun. 17, 2011 and claims the benefit thereof. The International Application claims the benefits of European application No. 10007335.2 filed Jul. 15, 2010, both of the applications are incorporated by reference herein in their entirety.

FIELD OF INVENTION

The present invention relates to a platform part for supporting a nozzle guide vane for a gas turbine and to a nozzle guide vane arrangement comprising the platform part. In particular, the present invention relates to a platform part for supporting a nozzle guide vane for a gas turbine, wherein the platform part is cooled by a cooling fluid guided in a channel within the platform part.

ART BACKGROUND

Components of a gas turbine are subjected to high wear due to a high temperature of impinging operation gas which is exhausted from a combustor. The components of a gas turbine subjected to high wear and subjected to high temperature of the operation gas may be in particular the nozzle guide vane or nozzle guide vanes immediately downstream of a combustor exit and a radially inner platform and/or a radially outer platform supporting the nozzle guide vane or the nozzle guide vanes.

EP 1 074 695 A2 discloses a method for forming a cooling passage in a turbine vane, wherein the cooling arrangement for a guide vane platform comprises a serpentine passage bounded by wall segments with cooling enhancement features.

U.S. Pat. No. 5,545,002 discloses a stator vane mounting platform having a cooling path defined by baffles.

EP 0 680 547 B1 discloses a turbine vane having dedicated inner platform cooling, wherein a cooling passage is formed using a pocket and a cover plate.

WO 2006/029983 discloses a turbine engine vane, wherein a shroud cooling channel is formed through which a cooling fluid flows during operation.

U.S. Pat. No. 5,538,393 discloses a turbine shroud segment including a serpentine cooling channel having a bent passage for flowing cooling fluid through an axial edge of a shroud segment.

There may be a need for a platform part for supporting a nozzle guide vane for a gas turbine having a higher durability and/or increase operation lifetime compared to a conventional platform part. In particular, there may be a need for a platform part for supporting a nozzle guide vane for a gas turbine allowing an improved cooling mechanism and/or capacity compared to a conventional platform part. Further, there may be a need for a platform part for supporting a nozzle guide vane for a gas turbine which can withstand, in particular for a longer time, a higher temperature of an operation gas compared to a conventional platform part.

SUMMARY OF THE INVENTION

This need may be met by the subject matter according to the independent claims. Advantageous embodiments of the present invention are described by the dependent claims.

According to an embodiment a platform part for supporting a nozzle guide vane for a gas turbine is provided, wherein the platform part comprises a gas passage surface arranged to be in contact with a streaming operation gas; and at least one cooling channel shaped for guiding a cooling fluid within the cooling channel, wherein the cooling channel is formed in an inside of the platform part, wherein a cooling portion of an inner surface of the cooling channel is in thermal contact with the gas passage surface, wherein the platform part is an integrally formed part representing a segment in a circumferential direction of the gas turbine. Thereby, the cooling channel comprises a first cooling channel portion and a second cooling channel portion arranged downstream of the first cooling channel portion with respect to a streaming direction of the operation gas, wherein in particular the first cooling channel portion and the second cooling channel portion are interconnected such that the cooling fluid is guided within the first cooling channel portion and then (i.e. afterwards) guided within the second cooling channel portion, wherein the first cooling channel portion and the second cooling channel portion both extend primarily along the circumferential direction.

The operation gas may be expelled from a combustor or a number of combustors arranged upstream of the nozzle guide vane and upstream of the gas passage surface of the platform part. Thereby, the operation gas may stream or flow in a streaming direction or flow direction which may allow to define a relative arrangement of components of the gas turbine. Thereby, a first component is considered to be arranged upstream from a second component, if the operation gas first impinges or reaches at the first component and afterwards reaches or impinges at the second component. In particular, the operation gas may flow in a streaming direction having a component in an axial direction and having a component in a radial direction and further having a component in a circumferential direction. Thereby, the axial direction may be a direction of a rotor shaft or a direction of a rotor axis around which the rotor shaft of the gas turbine rotates. At the rotor shaft one or more rotor blades may be fixed onto which operation gas deflected or directed from the nozzle guide vane may impinge to transfer a portion of its energy to the rotor blades, thus causing rotation of the rotor blades. Thereby, the rotor shaft may be rotated. The thus generated mechanical energy may for example be used to drive a generator to generate electrical energy or to transform the mechanical energy in any other form of energy, such as (another type of) mechanical energy.

The platform part may be a static component of the gas turbine which does not move or rotate during operation of the gas turbine. The platform part represents a segment in the circumferential direction of the gas turbine, wherein the circumferential direction is perpendicular to the axial direction and perpendicular to the radial direction, wherein the radial direction is also perpendicular to the axial direction.

In particular, the axial direction may be represented by the cylinder coordinate z, the radial direction may be represented by the cylinder coordinate r, and the circumferential direction may be represented by the cylinder coordinate $\varphi$.

A number of segments, such as 10 segments, 14 segments, 18 segments, 30 segments or even more segments may be assembled to form an annulus or forming a ring-shaped structure surrounding the rotation axis running along the axial direction. In particular, the platform part representing a (circumferential) segment may be connected to an adjacent (circumferential) platform part having a thin plate arranged between the adjacent (circumferential) platform parts. An annulus may be assembled from plural (circumferential) platform parts each representing a cylinder segment.

In particular, the platform part for supporting the nozzle guide vane may be a radially inner platform part or a radially outer platform part. In particular, the nozzle guide vane may be supported by the radially inner platform part at a radially inner portion of the nozzle guide vane and may be supported by the radially outer platform part at a radially outer portion of the nozzle guide vane. Thereby, the nozzle guide vane may be arranged between the radially inner platform part and the radially outer platform part.

In particular, the nozzle guide vane may comprise an upstream edge of the nozzle guide vane (where the operation gas is directed to) a downstream edge of the nozzle guide vane (where the operation gas leaves the nozzle guide vane), an upstream surface of the nozzle guide vane, and a downstream surface of the nozzle guide vane. Thereby, the operation gas may impinge at the upstream edge of the nozzle guide vane and at the upstream surface of the nozzle guide vane and may flow along the upstream surface of the nozzle guide vane and the downstream surface of the nozzle guide vane to be directed or guided towards a rotor blade or rotor blades arranged downstream the nozzle guide vane. Upon directing and/or deflecting the operation gas due to guidance by the nozzle guide vane the operation gas impinges on portions of the nozzle guide vane, thereby transferring thermal energy to the nozzle guide vane. Further, thermal energy may be transferred to the gas passage surface of the platform part from which the nozzle guide vane may protrude.

For cooling the gas passage surface of the platform part the heat energy transferred to the gas passage surface may be conducted from material at the gas passage surface towards an inside of the platform part. Thereby, the platform part may in particular be manufactured from a metal, such as a nickel based high temperature material. Thus, thermal energy received at the gas passage surface may be conducted through the (material of the) platform part to be exposed to the cooling portion of the inner surface of the cooling channel. Thereby, the cooling channel may be, except for an entry hole and exit hole(s), completely surrounded by material of the platform part such that the cooling channel essentially forms a cavity within the platform part. In particular, the cooling channel substantially is surrounded or enclosed by integrally formed material comprised in the platform part.

The cooling portion of the inner surface of the cooling channel is in thermal contact with the gas passage surface via heat conducting material, such as a metal. The cooling channel may provide a space into which the cooling fluid may be directed and within which the cooling fluid may flow or move. In particular, the cooling fluid may move within the cooling channel in a manner having a sufficient amount of turbulence for increasing heat transfer from the cooling portion of the inner surface of the cooling channel to the cooling fluid. In particular, a turbulent movement of the cooling fluid may involve a high rate of impingement of particles of the cooling fluid at the cooling portion of the inner surface of the cooling channel.

The cooling fluid may in particular be air, such as compressed air, in particular delivered by a compressor of the gas turbine or delivered by an external compressor.

The platform part is an integrally formed part, which may in particular be manufactured by casting, in particular by casting a metal, such as a nickel based high temperature material. Thus, the platform part may be a continuous single part which may avoid assembling the platform part from separate components, thus simplifying the manufacturing the platform part. Also, connection members, such as bolts or screws, may be avoided.

By providing the cooling channel in the inside of the platform part the cooling portion of the inner surface of the cooling channel may advantageously be arranged relatively close to the gas passage surface such that the heat energy absorbed at the gas passage surface may be conducted through material comprised in the platform part in an efficient way and/or at a sufficient large rate to the cooling portion, where the transferred heat energy is absorbed by the cooling fluid and carried away. Thereby, cooling of the platform part may be achieved at an increased rate or at a higher efficiency compared to the cooling performed according to the prior art.

In particular, the first cooling channel portion may be arranged closer to a region of the gas passage surface subjected to highest wear than the second cooling channel portion. In particular, a temperature of the cooling fluid guided within the first cooling channel portion may be lower than a temperature of the cooling fluid guided within the second cooling channel portion, since the cooling fluid may have absorbed heat from a cooling portion of an inner surface of the first cooling channel portion before it may have entered the second cooling channel portion. Thereby, selectively, particular portions of the gas passage surface may be cooled to a higher degree or to a higher rate compared to other portions of the gas passage surface.

According to an embodiment the cooling channel is configured (in particular structured, shaped or formed) such that an extent of the cooling channel in the (at least approximate) circumferential direction is at least three times greater than an extent of the cooling channel in any other direction. In general the cooling channel may extend in the axial direction, in the radial direction and in the circumferential direction. In particular, an extent in the circumferential direction is at least three times greater than an extent of the cooling channel in the radial direction or in the axial direction. Thus, the cooling channel may be elongated in the circumferential direction according to an embodiment. According to an alternative embodiment the channel may alternatively be elongated in the axial direction and narrower in the circumferential direction. According to an embodiment the extent of the cooling channel in the circumferential direction may amount to between 10 mm and 30 mm, in particular between 15 mm and 20 mm. In particular, an extent of the cooling channel in the axial direction may amount to between 3 mm and 15 mm, in particular 4 mm and 10 mm. Further, the extent of the cooling channel in the radial direction may amount to between 1 mm and 5 mm, in particular between 2 mm and 4 mm. However, these are only exemplary dimensions for a small gas turbine. If used in a large gas turbine, these dimensions may largely be exceeded (such as be a factor of 2, by a factor of 5, by a factor of 10 or even by a factor of 100) according to other embodiments.

The geometry and the shape of the cooling channel may advantageously influence the manner in which the cooling fluid flows within the cooling channel or moves within the cooling channel. In particular, the cooling fluid guided within the cooling channel may flow at least partially in the circumferential direction, although the flow of the cooling fluid may not be laminar but may be turbulent. Further, the cooling channel may be shaped such that a portion of the gas passage surface subjected to a particular high wear due to high temperature operation gas impinging onto it is effectively cooled by the cooling fluid circulating or moving within the cooling channel.

According to an embodiment the platform segment further comprises a turbulator protruding from the cooling portion of the inner surface of the cooling channel for increasing a turbulence of the cooling fluid guided within the cooling channel. The turbulator may at least partially function as a barrier for the cooling fluid to influence movement properties of the cooling fluid such as to provoke turbulent motion of the cooling fluid. Thereby, heat transfer from the cooling portion of the inner surface of the cooling channel to the cooling fluid may be improved. In particular, the turbulator may be formed as a wall protruding from the cooling portion, wherein the wall may extend transverse to a major flow direction of the cooling fluid.

According to an embodiment the turbulator is configured as a rib, a pimple and/or a pin fin.

According to an embodiment the turbulator extends along the cooling portion of the inner surface transversely to the circumferential direction. In particular, the turbulator may extend in a direction having a component in the axial direction and having a component in the circumferential direction, wherein a component in the radial direction may be at least five times, in particular at least 10 times, smaller than a component in the circumferential direction or in the axial direction. In particular, a protrusion amount of the turbulator may amount to between 0.5 mm and 2 mm according to an embodiment. However, in other embodiments these dimensions may largely be exceeded (such as be a factor of 2, by a factor of 5, by a factor of 10 or even by a factor of 100) for example for a large gas turbine.

Thereby, a turbulent flow of the cooling fluid may effectively be caused by the turbulator.

According to an embodiment the first cooling channel portion and the second cooling channel portion are adapted (in particular structured, shaped or formed) such that a first portion of the cooling fluid flows in a first direction within a first segment (which is in particular in communication with an entry hole for introducing the cooling fluid) of the first cooling channel portion; a second portion of the cooling fluid flows in a second direction (in particular at least approximately opposite to the first direction) within a second segment (which is in particular in communication with the entry hole for introducing the cooling fluid) of the first cooling channel portion; the first portion of the cooling fluid flows (in particular after changing its direction to the second direction at a connection member connecting the first segment of the first cooling channel portion with the first segment of the second cooling channel portion) within a first segment of the second cooling channel portion; and the second portion of the cooling fluid flows (in particular after changing its direction to the first direction at a further connection member connecting the second segment of the first cooling channel portion with the second segment of the second cooling channel portion) within a second segment of the second cooling channel portion, wherein the first portion of the cooling fluid and the second portion of the cooling fluid flow towards each other (in particular opposite to each other), in particular join each other, within the second cooling channel portion. Thereby, cooling effectiveness may be improved.

According to an embodiment the platform segment further comprises an entry hole for introducing the cooling fluid into the cooling channel, wherein the entry hole is arranged at an upstream side of the cooling channel with respect to a streaming direction of the operation gas. The cooling fluid may be introduced into the channel via the entry hole from a region of the gas turbine arranged radially inwards from the cooling channel. A width and a height of the entry hole may have similar dimensions as the radial extent and the axial extent of the cooling channel, respectively.

According to an embodiment the platform segment further comprises an exit hole for allowing the cooling fluid to exit the cooling channel towards the streaming operation gas, in particular to exit that cooling channel portion of the cooling channel arranged farthest downstream with respect to a streaming direction of the operation gas. Thereby, cooling fluid exiting the cooling channel via the exit hole may perform so-called "film cooling" of a portion of the gas passage surface. Thereby, the cooling fluid may flow close to the gas passage surface and may provide a cooling fluid buffer such that the operation gas may be hindered to extensively impinge at the gas passage surface. Thereby, additional cooling by the cooling fluid may be provided. In contrast, the cooling performed within the cooling channel may be effected by convection.

In particular, the cooling channel may be arranged at an axial position of a downstream edge of the nozzle guide vane. In a region of the gas passage surface around the axial position of the downstream edge of the nozzle guide vane the gas passage surface may be subjected to highest wear due to the impingement of operation gas. Thereby, by arranging the cooling channel in particular at this critical axial position the performance and/or durability of the platform part may be improved.

According to an embodiment the exit hole is configured (in particular structured, shaped or formed) such that the exiting cooling fluid cools the gas passage surface, in particular at an axial position of a downstream edge of the nozzle guide vane. Cooling at this particular axial position may be in particular beneficial, as the gas passage surface at this axial position may be at a particular high stress during operation of the gas turbine.

According to an embodiment the exit hole opens towards a rotor stator cavity. Thereby, additional cooling holes at the gas passage surface may be avoided.

According to an embodiment a nozzle guide vane arrangement is provided, which comprises a platform part for a nozzle guide vane for a gas turbine according to any of the embodiments described above and a nozzle guide vane supported at the platform part and protruding from the gas passage surface. In particular, the nozzle guide vane may be supported by a radially inner platform part and/or a radially outer platform part according to an embodiment.

According to an embodiment the cooling channel is arranged axially downstream of the nozzle guide vane with respect to a streaming direction of the operation gas. In particular, the cooling channel may be arranged axially downstream of a downstream edge of the nozzle guide vane, where the gas passage surface is subjected to especially high stress due to impinging high temperature operation gas. Thereby, an efficiently cooled nozzle guide vane arrangement may be provided.

According to an embodiment the platform part supports the nozzle guide vane at a radially inner portion of the nozzle guide vane. In particular, the radially inner platform part may be subjected to especially high stress, requiring extensive cooling.

According to an embodiment the nozzle guide vane arrangement is an integrally formed part, in particular a single cast part. In particular, the nozzle guide vane arrangement may be cast from a metal, such as steel, to provide a cylinder segment comprising one or more nozzle guide vanes, such as two nozzle guide vanes, which are supported by a radially inner platform portion and a radially outer platform portion from which at least one may be cooled using a cooling channel.

According to an embodiment a method for manufacturing a platform part for supporting a nozzle guide vane for a gas turbine is provided, wherein the platform part represents or provides a segment in a circumferential direction of the gas turbine, wherein the manufacturing method comprises arranging a gas passage surface to be in contact with a streaming operation gas; forming a cooling channel in an inside of the platform part; and shaping the cooling channel for guiding a cooling fluid such that a cooling portion of an inner surface of the cooling channel is in thermal contact with the gas passage surface, wherein the platform part is integrally formed, in particular by casting.

It has to be noted that embodiments of the invention have been described with reference to different subject matters. In particular, some embodiments have been described with reference to method type claims whereas other embodiments have been described with reference to apparatus type claims.

However, a person skilled in the art will gather from the above and the following description that, unless other notified, in addition to any combination of features belonging to one type of subject matter also any combination between features relating to different subject matters, in particular between features of the method type claims and features of the apparatus type claims is considered as to be disclosed with this document.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
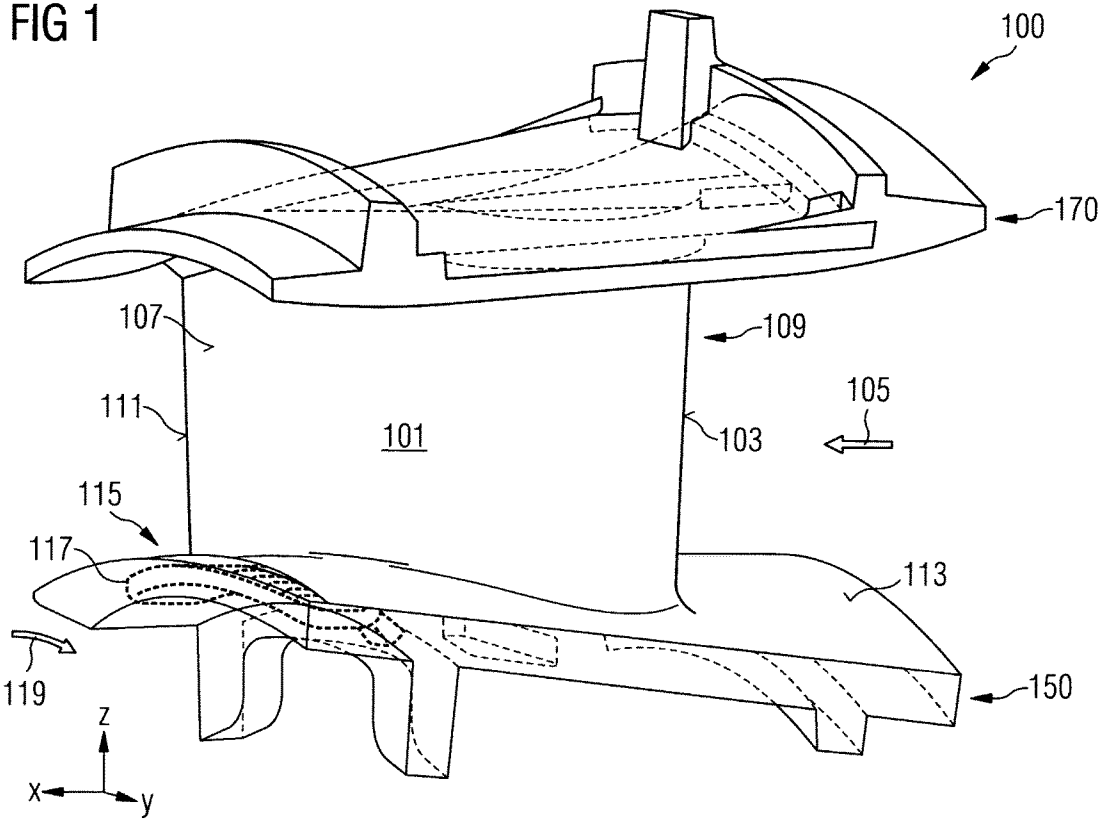
FIG. 1 schematically illustrates a perspective view of a nozzle guide vane arrangement according to an embodiment.

The illustration in the drawing is schematically. It is noted that in different figures, similar or identical elements are provided with the same reference signs or with reference signs, which are different from the corresponding reference signs only within the first digit.

FIG. 1 schematically shows a perspective view of a nozzle guide vane arrangement 100 according to an embodiment. The nozzle guide vane arrangement comprises a radially inner platform part 150 and a radially outer platform part 170. The radially inner platform part 150 and the radially outer platform part 170 support a nozzle guide vane 101. The nozzle guide vane 101 has an aerofoil profile having an upstream edge 103 facing an operation gas streaming in a direction 105. The nozzle guide vane 101 further comprises a downstream surface 107 and an upstream surface 109, wherein the operation gas streams along the upstream surface 109 and the downstream surface 107 to meet at the downstream edge 111 where the operation gas leaves the nozzle guide vane 101.

A rotation axis of a rotor of the gas turbine may extend approximately along the x-direction. Thereby, in the FIGS. 1, 2 and 3 the x-direction may correspond to the axial direction.

The radially inner platform part 150 is integrally formed, in particular integrally formed together with the guide vane 101 and the radially outer platform part 170. The radially inner platform part 150 comprises a gas passage surface 113 which is in contact with the operation gas which may have been exhausted by a combustor. In a region 115 of the gas passage surface 113 located downstream of the nozzle guide vane 101 and in particular downstream the downstream edge 111 of the nozzle guide vane 101 the gas passage surface 113 may be subjected to especially high wear end stress due to impinging hot operation gas.

To effect cooling of the region 115 of the gas passage surface 113, a channel 117 is formed within the radially inner platform part 150. The channel 117 primarily extends in a circumferential direction 119. As can be seen from the drawing of FIG. 1, the channel 117 is provided in an inside of the radially inner platform part 150 below the region 115 of the gas passage surface 113, in order to cool the region 115 of the gas passage surface 113. Heat absorbed at the region 115 is conducted through the metal of the platform part 150 and is exposed to an inner surface of the channel 117 over which a cooling fluid, such as compressed air, is guided. The cooling fluid interacts with the inner surface of the cooling channel 117 and receives a portion of the heat energy being originally absorbed at the region 115 of the gas passage surface 113.

Figure 2:
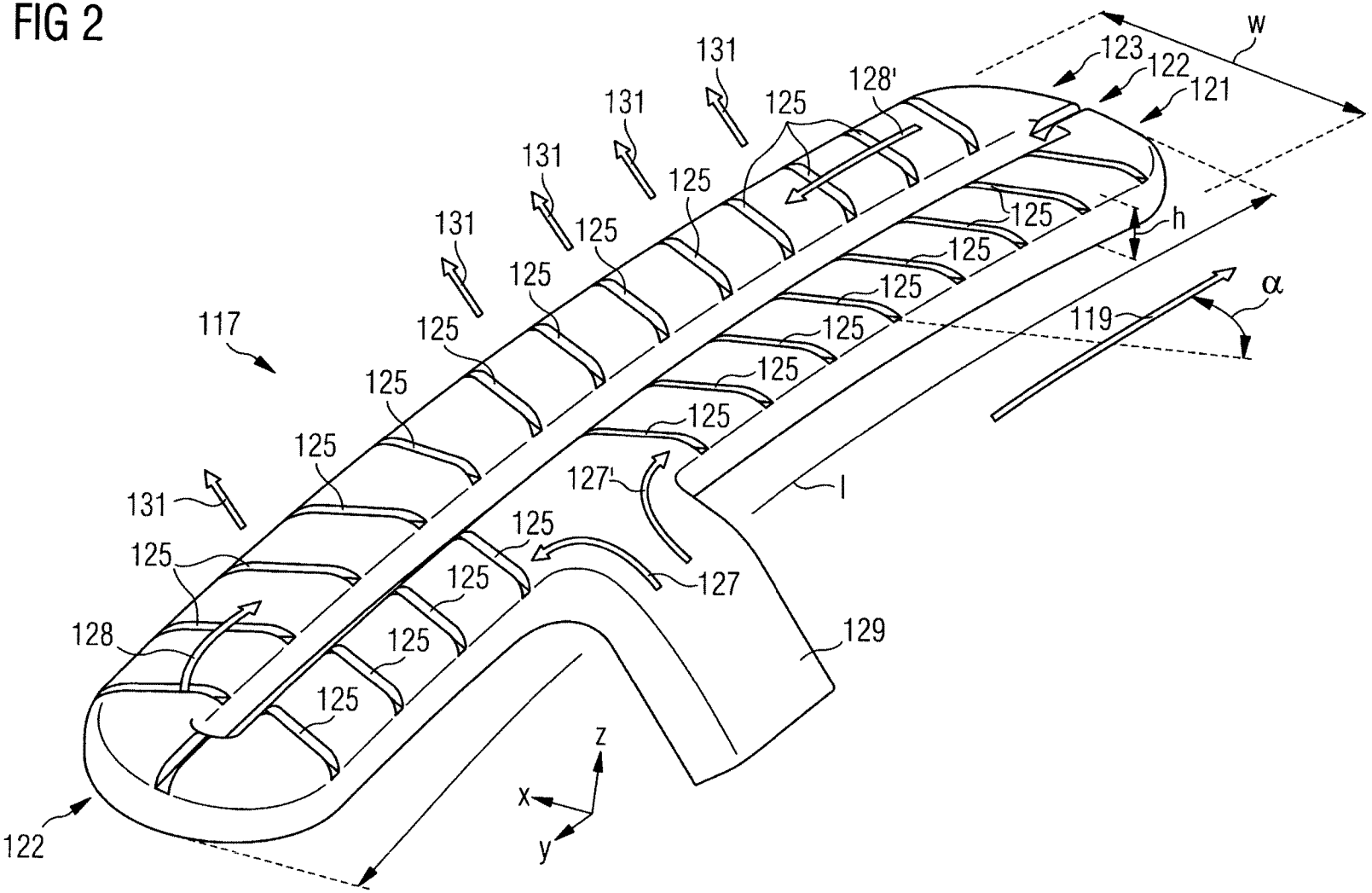
FIG. 2 schematically illustrates a shape of a cooling channel which can be used in a platform segment for supporting a nozzle guide vane for a gas turbine according to an embodiment.

FIG. 2 schematically illustrates a perspective view of a negative of the cooling channel 117. Thus, the structure shown in FIG. 2 represents the shape of the channel 117 (i.e. the shape of a cavity) formed within the radially inner platform part 150 illustrated in FIG. 1. The cooling channel 117 comprises a first cooling portion 121 and a second cooling portion 123 which are interconnected to each other using curved channel portions 122. The first cooling channel portion 121 and the second cooling channel portion 123 are arranged parallel to each other and both extend primarily (i.e. to a maximal extent) along the circumferential direction 119.

In particular, a length l of the first cooling channel portion 121 and the second cooling channel portion 123 is around 18 mm in the illustrated embodiment. Further, the first cooling channel portion 121 and the second cooling channel portion 123 extends in the axial direction (oriented approximately along the x-direction) to a width w which amounts to 4 mm to 6 mm. Further, the first cooling channel portion 121 and the second cooling channel portion 123 extend in a radial direction (oriented approximately along the z-direction) to a height h which amounts to about 3 mm. Other dimensions are also possible.

The first channel cooling portion 121 and the second cooling channel portion 123 further comprise turbulators 125 providing small barriers for the cooling fluid flowing along the direction as indicated by arrows 127, 127'. The turbulators 125 extend across the entire width w of the first cooling channel portion 121 and the second cooling channel portion 123. In particular, the turbulators 125 extend transverse to the circumferential direction 119, in particular include an angle $\alpha$ with the circumferential direction, wherein $\alpha$ may range between 60° and 120°. The turbulators 125 act as partial barriers for the cooling fluid, in particular cooling air, flowing within the cooling channel 117 along the directions 127, 127'. Thereby, a turbulence of the movement of the cooling fluid is increased to improve the heat transfer from the inner surface of the cooling channel to the cooling fluid.

The cooling fluid, in particular a compressed air, may be delivered to the cooling channel via the entry hole 129. In particular, the entry hole 129 is arranged at an upstream side of the cooling channel 117, where the first cooling channel portion 121 is arranged. Thus, the cooling fluid introduced via the entry hole 129 first flows into the first cooling channel portion 121 bifurcating at the entry hole 129 in two opposite directions 127 and 127'. The cooling fluid passes along the first cooling channel portion 121 thereby absorbing heat energy from the inner surface of the first cooling channel portion 121. Afterwards, the cooling fluid passes through the curved portions 122 of the cooling channel 117 and enters the second cooling channel portion 123 in two opposite directions 128 and 128'. The cooling fluid is guided within the second cooling channel portion 123 and absorbs further heat energy from an inner surface of the second cooling channel portion 123.

The cooling fluid may exit the cooling channel 117 via one or more exit holes (not illustrated in FIG. 2) which lead to an operation gas passage which is in communication with the gas passage surface 113 illustrated in FIG. 1. Thereby, the cooling fluid exits the cooling channel 117 as indicated by arrows 131. The cooling fluid exiting via the cooling holes in the radially inner platform part 150 may cool the region 115 of the gas passage surface 113 by film cooling.

Figure 3:
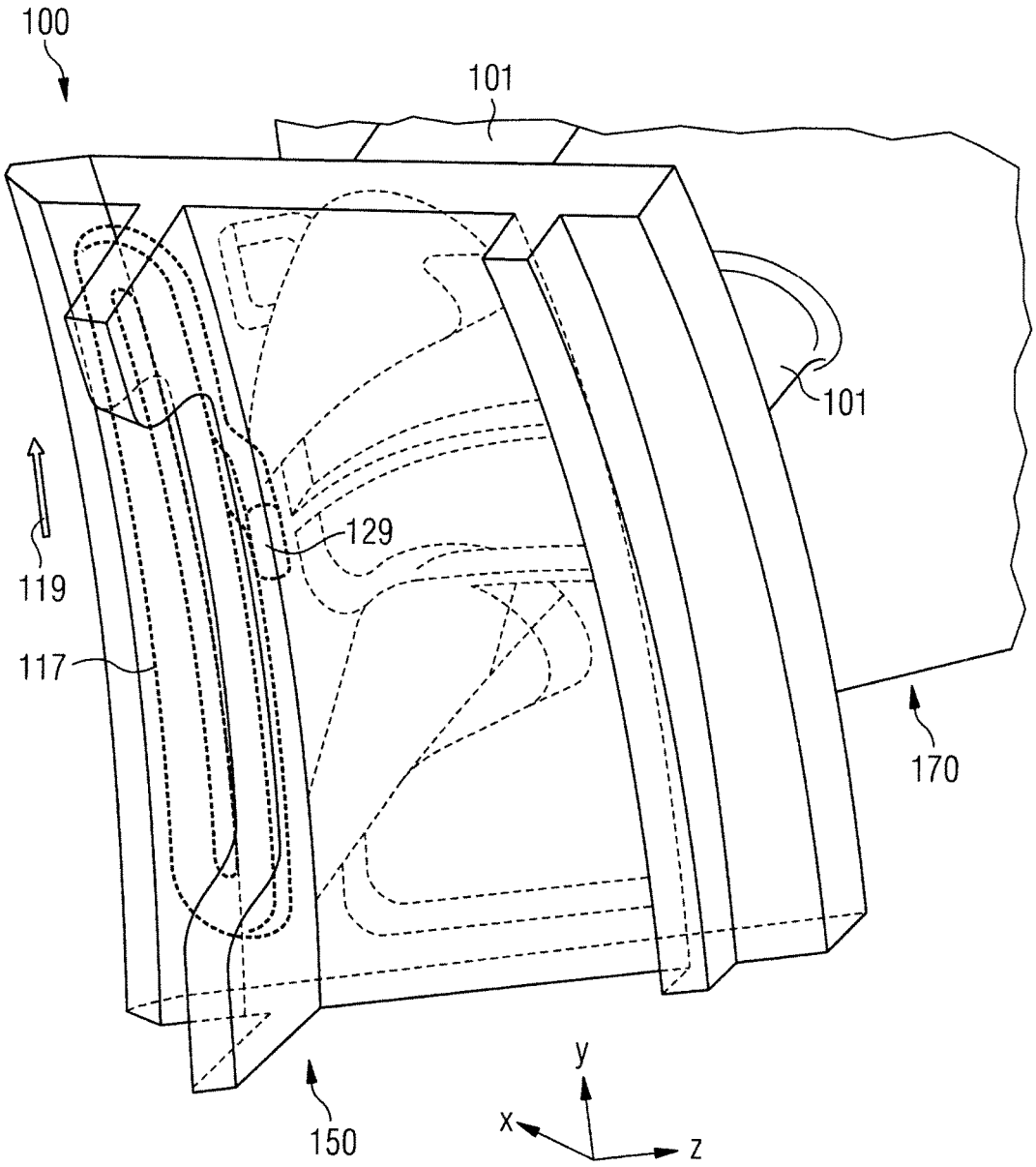
FIG. 3 schematically shows the nozzle guide vane arrangement illustrated in FIG. 1 in a perspective view from an underside.

FIG. 3 schematically illustrates a perspective view of the nozzle guide vane arrangement 100 illustrated in FIG. 1 from an underside (i.e. looking radially outwards from a position close to the rotation axis). The cooling channel 117 is depicted as a broken line as in FIG. 1. As can be seen from the illustration of FIG. 3 the cooling channel 117 is arranged at an axial position (the axial direction running approximately along the x-direction) corresponding to an axial position of the downstream edge 111 of the nozzle guide vane 101. In particular, in this region corresponding to the region 115 of the gas passage surface 113 illustrated in FIG. 1 the hot operation gas may have particular severe influence on the integrity of the gas passage surface 113. As can also be seen from FIG. 3, the nozzle guide vane arrangement 100 comprises two nozzle guide vanes 101 spaced apart in the circumferential direction 119.

In other embodiments, the cooling channel 117 may also be present in the radially outer platform segment 170 illustrated in FIG. 1.

Embodiments may in particular address problems of a platform region of a nozzle guide vane which is subjected to hot gas temperatures. Conventionally, such regions may be cooled by impingement cooling, conduction cooling or film cooling. According to an embodiment a high degree of cooling of the platform region is achieved, where conventional methods of cooling are not possible due to geometric restrictions or the amount of cooling is insufficient to ensure a satisfactory service life of the nozzle guide vane support structure. In particular, film cooling may be subjected to mixing and distortion by the hot operation gas, especially if there is a high amount of spatial temperature variation.

According to an embodiment a cavity (also referred to as cooling channel) is cast in the platform part between the gas-washed (operation gas exposed) and no gas-washed surfaces with multiple interconnected passages. Cooling fluid, such as compressed air, may be fed into this cavity and may pass along each passage, thus cooling the passage walls by convection. The cooling of the wall closest to the hot gas may be enhanced by features within the cavity or cooling channel, to increase the turbulence of the cooling air, such as by providing ribs, pimples and/or pin fins. The cooling air may be ejected out of the cavity via one or more exit holes to either the gas washed surface (also referred to as gas passage surface), where it may provide film cooling, or into the rotor stator cavity.

According to an embodiment cooling of the nozzle guide vane platform is enabled, where conventional methods are not possible due to geometric features of the nozzle guide vane platform or where conventional methods provide insufficient cooling of the platform.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A platform part for supporting a nozzle guide vane for a gas turbine, comprising:

a gas passage surface arranged to be in contact with a streaming operation gas; and a cooling channel for guiding a cooling fluid within the cooling channel, an entry hole for introducing the cooling fluid into the cooling channel, wherein the entry hole is arranged at an upstream side of the cooling channel with respect to a streaming direction of the operation gas, wherein the cooling channel is formed in an inside of the platform part, wherein a cooling portion of an inner surface of the cooling channel is in thermal contact with the gas passage surface, wherein the platform part is an integrally formed part representing a segment in a circumferential direction of the gas turbine, wherein the cooling channel comprises a first cooling channel portion and a second cooling channel portion, wherein the second cooling channel portion is arranged downstream of the first cooling channel portion with respect to the streaming direction of the operation gas, wherein the first cooling channel portion and the second cooling channel portion are interconnected such that the cooling fluid is guided within the first cooling channel portion and then guided within the second cooling channel portion, and wherein the first cooling channel portion and the second cooling channel portion extend along the circumferential direction of the gas turbine and are adapted such that:

a first portion of the cooling fluid flows in a first direction within a first segment of the first cooling channel portion;

a second portion of the cooling fluid flows in a second direction within a second segment of the first cooling channel portion;

the first portion of the cooling fluid flows within a first segment of the second cooling channel portion; and the second portion of the cooling fluid flows within a second segment of the second cooling channel portion, wherein the first portion of the cooling fluid and the second portion of the cooling fluid flow towards each other and join each other within the second cooling channel portion, wherein the entry hole introduces the cooling fluid directly into the first cooling channel portion from upstream of the first cooling channel portion from a region of the gas turbine arranged, in reference to the cooling channel, radially away from the nozzle guide vane.

2. The platform part according to claim 1, wherein the cooling channel is configured such that a consistent extent of the cooling channel in the circumferential direction is at least three times greater than an extent of the cooling channel in any other direction.

3. The platform part according to claim 1, further comprising a plurality of turbulators protruding from the cooling portion of the inner surface of the cooling channel for increasing a turbulence of the cooling fluid guided within the cooling channel.

4. The platform part according to claim 3, wherein the turbulator extends along the cooling portion of the inner surface transversely to the circumferential direction.

5. The platform part according to claim 1, further comprising an exit hole for allowing the cooling fluid to exit the cooling channel towards the streaming operation gas.

6. The platform part according to claim 5, wherein the exit hole exits the cooling fluid from the cooling channel portion of the cooling channel arranged farthest downstream with respect to the streaming direction of the operation gas.

7. The platform part according to claim 5, wherein the exit hole is configured such that the exiting cooling fluid cools the gas passage surface at an axial position of a downstream edge of the nozzle guide vane.

8. The platform part according to claim 5, wherein the exit hole opens towards a rotor stator cavity.

9. A nozzle guide vane arrangement, comprising:

the platform part for the gas turbine according to claim 1; and the nozzle guide vane supported at the platform part and protruding from the gas passage surface of the platform part.

10. The nozzle guide vane arrangement according to claim 9, wherein the cooling channel is arranged axially downstream of the nozzle guide vane with respect to the streaming direction of the operation gas.

11. The nozzle guide vane arrangement according to claim 9, wherein the platform part supports the nozzle guide vane at a radially inner portion of the nozzle guide vane.

12. The nozzle guide vane arrangement according to claim 9, wherein the nozzle guide vane arrangement is an integrally formed part.

13. A method for manufacturing a platform part for supporting a nozzle guide vane for a gas turbine, comprising:

arranging a gas passage surface to be in contact with a streaming operation gas;

forming a cooling channel in an inside of the platform part; and guiding a cooling fluid within the cooling channel such that a cooling portion of an inner surface of the cooling channel is in thermal contact with the gas passage surface, arranging an entry hole for introducing the cooling fluid into the cooling channel, the entry hole arranged at an upstream side of the cooling channel with respect to a streaming direction of the operation gas, wherein the cooling fluid is from a region of the gas turbine arranged, in reference to the cooling channel, radially away from the nozzle guide vane, wherein the platform part is integrally formed and provides a segment in a circumferential direction of the gas turbine, wherein the cooling channel comprises a first cooling channel portion and a second cooling channel portion, wherein the second cooling channel portion is arranged downstream of the first cooling channel portion with respect to the streaming direction of the operation gas, wherein the first cooling channel portion and the second cooling channel portion are interconnected such that the cooling fluid is guided within the first cooling channel portion and then guided within the second cooling channel portion, and wherein the first cooling channel portion and the second cooling channel portion extend along the circumferential direction of the gas turbine and are adapted such that:

a first portion of the cooling fluid flows in a first direction within a first segment of the first cooling channel portion;

a second portion of the cooling fluid flows in a second direction within a second segment of the first cooling channel portion;

the first portion of the cooling fluid flows within a first segment of the second cooling channel portion; and the second portion of the cooling fluid flows within a second segment of the second cooling channel portion, wherein the first portion of the cooling fluid and the second portion of the cooling fluid flow towards each other and join each other within the second cooling channel portion, wherein the entry hole introduces the cooling fluid directly into the first cooling channel portion from upstream of the first cooling channel portion.

14. A platform part for supporting a nozzle guide vane for a gas turbine, comprising:

a gas passage surface arranged to be in contact with a streaming operation gas; and a cooling channel for guiding a cooling fluid within the cooling channel, an entry hole for introducing the cooling fluid into the cooling channel, wherein the entry hole is arranged at an upstream side of the cooling channel with respect to a streaming direction of the operation gas, wherein the cooling channel is formed in an inside of the platform part, wherein a cooling portion of an inner surface of the cooling channel is in thermal contact with the gas passage surface, wherein the platform part is an integrally formed part representing a segment in a circumferential direction of the gas turbine, wherein the cooling channel comprises a first cooling channel portion and a second cooling channel portion, wherein the second cooling channel portion is arranged downstream of the first cooling channel portion with respect to the streaming direction of the operation gas, wherein the first cooling channel portion and the second cooling channel portion are interconnected such that the cooling fluid is guided within the first cooling channel portion and then guided within the second cooling channel portion, and wherein the first cooling channel portion and the second cooling channel portion extend along the circumferential direction of the gas turbine and are adapted such that:

a first portion of the cooling fluid flows in a first direction within a first segment of the first cooling channel portion;

a second portion of the cooling fluid flows in a second direction within a second segment of the first cooling channel portion;

the first portion of the cooling fluid flows within a first segment of the second cooling channel portion; and the second portion of the cooling fluid flows within a second segment of the second cooling channel portion, wherein the first portion of the cooling fluid and the second portion of the cooling fluid flow towards each other and join each other within the second cooling channel portion, wherein the cooling channel is configured such that a consistent extent of the cooling channel in the circumferential direction is at least three times greater than an extent of the cooling channel in any other direction, wherein the entry hole introduces the cooling fluid directly into the first cooling channel portion from upstream of the first cooling channel portion from a region of the gas turbine arranged, in reference to the cooling channel, radially away from the nozzle guide vane.

* * * * *